US011692738B2

(12) United States Patent
Gotoh et al.

(10) Patent No.: US 11,692,738 B2
(45) Date of Patent: Jul. 4, 2023

(54) ELECTRIC FLUID FLOW HEATER WITH HEATING ELEMENT SUPPORT MEMBER

(71) Applicant: Kanthal GmbH, Düsseldorf (DE)

(72) Inventors: Kazutaka Gotoh, Chiba (JP); Satoshi Sugai, Chiba (JP); Markus Mann, Mörfelden-Walldorf Hessen (DE)

(73) Assignee: Kanthal GmbH, Düsseldorf (DE)

( * ) Notice: Subject to any disclaimer, the term of this patent is extended or adjusted under 35 U.S.C. 154(b) by 447 days.

(21) Appl. No.: 16/770,092

(22) PCT Filed: Dec. 7, 2018

(86) PCT No.: PCT/EP2018/083966

§ 371 (c)(1),
(2) Date: Jun. 5, 2020

(87) PCT Pub. No.: WO2019/110798

PCT Pub. Date: Jun. 13, 2019

(65) Prior Publication Data

US 2020/0386442 A1 Dec. 10, 2020

(30) Foreign Application Priority Data

Dec. 8, 2017 (EP) ..... 17206190

(51) Int. Cl.
*F24H 3/00* (2022.01)
*H05B 3/44* (2006.01)

(52) U.S. Cl.
CPC ..... *F24H 3/002* (2013.01); *H05B 3/44* (2013.01); *H05B 2203/003* (2013.01); *H05B 2203/022* (2013.01)

(58) Field of Classification Search
CPC ..... F24H 3/002; F24H 1/01; F24H 1/0018; H05B 3/42; H05B 3/44
See application file for complete search history.

(56) References Cited

U.S. PATENT DOCUMENTS 1,727,584 A 9/1929 Carleton
2,619,579 A 11/1952 Cartinhour
(Continued)

FOREIGN PATENT DOCUMENTS

CN 102811514 A 12/2012
CN 203163236 U 8/2013
(Continued)

OTHER PUBLICATIONS

International Search Report and Written Opinion dated Feb. 15, 2019, issued in corresponding International Patent Application No. PCT/EP2018/083966.
(Continued)

*Primary Examiner* — Erin E McGrath
(74) *Attorney, Agent, or Firm* — Morgan, Lewis & Bockius LLP

(57) ABSTRACT

An electric heater to heat a flow of a fluid having a jacket block comprising a plurality of longitudinal bores to allow the through-flow of a gas phase medium. An elongate heating element extends through each of the bores and is positionally stabilised relative to the jacket block via at least one support member, optionally in the form or an elongate rod to inhibit undesirable independent axial and/or lateral movement of the heating element relative to the jacket block.

22 Claims, 5 Drawing Sheets

(56) References Cited

U.S. PATENT DOCUMENTS

| | | | | |
|---|---|---|---|---|
| 4,016,403 | A * | 4/1977 | Best | H05B 3/64 373/134 |
| 4,233,494 | A | 11/1980 | Pawlik et al. | |
| 5,027,425 | A * | 6/1991 | Slomka | H05B 3/44 392/480 |
| 6,050,328 | A | 4/2000 | Shikazono et al. | |
| 9,867,232 | B2 | 1/2018 | Mann et al. | |
| 10,251,217 | B2 | 4/2019 | Gotoh | |
| 2007/0235444 | A1 * | 10/2007 | Lewin | H05B 3/44 219/602 |
| 2017/0094725 | A1 | 3/2017 | Mann et al. | |
| 2020/0386443 | A1 | 12/2020 | Schatz et al. | |

FOREIGN PATENT DOCUMENTS

| | | | |
|---|---|---|---|
| DE | 1615278 | A1 | 7/1970 |
| DE | 2732133 | A1 | 1/1979 |
| EP | 2926623 | B2 | 5/2019 |
| JP | H05-315052 | A | 11/1993 |
| JP | H10-213386 | A | 8/1998 |
| JP | 2016-531379 | A | 10/2016 |
| JP | 2017-510021 | A | 4/2017 |
| KR | 10-2012-0105691 | A | 9/2012 |
| WO | 2005/006812 | A1 | 1/2005 |

OTHER PUBLICATIONS

Office Action issued in European Application No. 18819051.6 dated Oct. 18, 2022.

Office Action issued in Japanese Application No. 2020-530987 dated Oct. 25, 2022.

Translation of Office Action dated Jan. 30, 2023, issued in corresponding Korean Patent Application No. 10-2020-7016007.

* cited by examiner

ELECTRIC FLUID FLOW HEATER WITH HEATING ELEMENT SUPPORT MEMBER

FIELD OF INVENTION

The present invention relates to an electric heater to heat a flow of a fluid, and in particular although not exclusively, to an electric heater having at least one support member to inhibit axial and/or lateral movement of a heating element passing within a jacket block.

BACKGROUND ART

Electric heaters for heating gases to high temperatures typically include a tube adapted for the through-flow of a gas and an electrical heating element positioned within the tube to transfer heat to the gas as it flows into an open first end of the tube, passed the wire and then out of the tube via an open second end.

Conventionally, relatively fine wires are wound in a spiral configuration within the tube such that the heating effect is achieved by passing current through the wires as the gas flows through the tube. Accordingly, the effectiveness of the conversion of the electrical energy into heat (via the heating wire) depends for example on the available electrical voltage applied and the resistance of the wire. Accordingly, the effectiveness of the electric heater is dependent, in part, on the maximum temperature achievable by the wire, the flow resistance and the surface area available for heat exchange. Typically, maximum gas temperatures that may be achieved with conventional electric process heaters may be of the order or around 700 to 900° C. However, the higher the temperature the greater the tendency for fracture and failure of the wire.

More recently, EP 2926623 discloses an electric flow heater in which the heating wire is replaced with a heating rod having a defined cross-sectional ratio between that of the rod and the tubular bore through which the rod extends. A single heating element extends through multiple bores (formed within elongate tubular elements) via a plurality of bent (or looped) ends. Gas heating temperatures of up to 1200° C. are disclosed.

Whilst convention electric heaters may be capable of achieving high temperatures of the order of 1100° C., high gas speeds and large pressure differentials cause vibration and movement of the heating elements (and the surrounding tubes (heating block)) such that the heating elements are still subject to mechanical impacts and stress which inevitably result in breakage. This phenomenon is even more pronounced when the elongate tube (heating block) is orientated vertically such that gravitational forces further contribute to the stresses and physical demands on the heating elements. Accordingly, what is required is an electric fluid flow heater that addresses these problems.

SUMMARY OF THE INVENTION

Accordingly, it is an aspect of the present invention to provide an electric flow heater to heat a fluid and in particular a gas (gas-phase medium) capable of achieving modest to high heating temperatures of the order of 700° C., 1000° C. and potentially up to 1200° C. with minimised physical stress, fatigue and damage at the heating element so as to greatly enhance the service lifetime of the electric heater. It is a further objective to stabilise the heating element extending within at least one jacket element (alternatively termed a tubular element) that may define an elongate jacket block such that independent movement of the heating element relative to the jacket element is minimised and preferably eliminated.

It is a further specific aspect to positionally stabilise the heating element at or towards the bent or looped end sections of the heating element that emerge from the at least one jacket element/jacket block so as to minimise independent movement of the heating element relative to the at least one jacket element/jacket block.

The aspects are achieved, via an electric fluid flow heater having at least one support member that is connected or projects from a casing of the heater so as to contact bent axial end sections of the heating element an inhibit any axial and/or lateral movement of the heating element relative to the jacket element, jacket block and/or casing. Additionally, in certain implementations, axial movement of the jacket elements (jacket block) relative to the casing may be prevented.

Optionally, the fluid may be liquid, a vapour containing gas phase medium, a vapour enriched gas phase medium, a liquid vapour-gas phase medium.

According to a first aspect of the present invention there is provided an electric heater to heat a flow of a fluid comprising: at least one axially elongate jacket element defining an axially elongate jacket block having first and second lengthwise ends; a plurality of longitudinal bores or channels extending internally through the jacket block and being open at each of the respective first and second lengthwise ends; at least one heating element extending axially through the bores or channels and having respective bent axial end sections such that the at least one heating element emerges from and returns into adjacent or neighbouring bores or channels at one or both the respective first and second lengthwise ends, the at least one heating element and the jacket block forming a heating assembly; and a casing positioned to at least partially surround the heating assembly; characterised by: at least one support member connected to or projecting from the casing to contact at least some of the bent axial end sections and inhibit axial and/or lateral movement of the at least one heating element relative to the jacket block and/or the casing.

Reference within this specification to 'at least one axially elongate jacket element' and 'axially elongate jacket block' encompass a cover, a sleeve and other jacket-type elements having a length that is greater than a corresponding width or thickness so as to be 'elongate' in an axial direction of the heater. Reference to such 'elongate' elements and blocks encompasses bodies that are substantially continuously solid between their respective lengthwise ends and that do not comprise gaps, voids, spacings or other separations or between the lengthwise ends.

Preferably, the elongate jacket elements and elongate jacket blocks are substantially straight/linear bodies comprising at least one respective internal bore to receive straight or linear sections of heating element. Accordingly, the present jacket elements and jacket blocks is configured to substantially encase surround, cover, house or contain the straight/linear sections of the heating element substantially along the length of the straight/linear sections between bent or curved end sections of the heating element. Accordingly, it is preferred that the bent or curved sections of the heating element only project from and are not covered or housed by the heating element/jacket block. Accordingly, reference within this specification to 'jacket' element and 'jacket' block encompass respective hollow bodies to contain, house, surround or jacket a heating element substantially continuously between the bent or curved end sections of the heating element that project from the respective lengthwise ends of the jacket element/block.

The effect of elongate jacket element and jacket block having a corresponding axially elongate internal bore is to maximise the efficiency of thermal energy transfer between the heating element and the fluid flowing through the bore in close confinement around the heating element. The lengthwise elongate configuration of the heating element and block provides that the flowing fluid is appropriately contained within the bore around the heating element substantially the full length of the straight/linear section of heating element.

Within this specification, reference to the respective first and second lengthwise ends of a heating element that emerges from the bores or channels within the elongate heating element/jacket block, may be considered to be distinguished from the straight/linear sections of heating element that are housed continuously within the bore of the element/block. As will be appreciated, almost all of the thermal transfer between heating element and fluid occurs within the elongate bore(s).

According to one embodiment of the invention as defined hereinabove or hereinafter, the at least one support member comprises at least one rod extending between the bent axial end sections and the first lengthwise end of the jacket block. The use of at least one rod is advantageous to provide a simple and effective construction to stabilise the heating element relative to the jacket block and/or the casing for obtaining the advantages mentioned above. Preferably, the support member comprises a plurality of rods, each rod extending respectively between each of a plurality of bent axial end sections and the first lengthwise end.

Optionally, each rod is positioned in contact or near-touching contact with the heating element at respective inner regions of the bent axial end sections. Accordingly, the rods provide a direct means of support of the heating element so as to minimise and preferably eliminate any independent axial and optionally lateral movement of the heating element relative to the jacket block/casing. The use of a rod inserted within the bent end sections does not otherwise obstruct the free-flow of fluid into, through and out of the jacket block as the at least one rod is positioned to the lateral side of each opening of the elongate bores (extending through the jacket block).

The present arrangement is advantageous to maximise the extent and efficiency of thermal energy transfer between the heating element and the fluid by providing unobstructed fluid flow within the elongate bore(s) between the respective lengthwise ends of the elongate jacket element/block. Accordingly, the positional support member that positionally stabilises the heating element at the bent/curved sections (that project from the jacket element/jacket block) do not interfere with the fluid flow and therefore energy transfer efficiency. In particular, the support element does not contact the heating element at the linear straight section between the respective curved/bent end sections of the heating element.

According to one embodiment of the invention as defined hereinabove or hereinafter, the plurality of bent axial end sections is positioned adjacent one another and are aligned in a row and a respective rod extends through the bent axial end sections of the row. Such an arrangement is advantageous to minimise the number of support rods at the heater whilst stabilising the heating element at multiple regions along its length corresponding to the bent axial end sections. Optionally, each of the rods comprise a recess to at least partially receive a portion of the at least one heating element at each of the respective bent axial end sections. Each recess is advantageous to further enhance the positional stabilisation of the heating element relative to the jacket block and in particular to greatly inhibit any lateral displacement of the heating element. Optionally, the support member comprises a generally circular, polygonal or rectangular cross sectional profile.

According to specific implementations, the heating element is bent through 170° to 190°, 175° to 185° or generally 180° at each axial end section. Such an arrangement is beneficial to provide a lightweight electric flow heater of compact construction via a single heating element passing in-series through each elongate bore of the jacket block.

According to one embodiment of the invention as defined hereinabove or hereinafter, the support member comprises a non-electrically conducting material such as a refractory or a ceramic material. Optionally, the non-electrically conducting material is formed as a coating at the support member. Optionally, and according to specific implementations, the support member comprises a metallic core and a refractory coating or ceramic coating which will at least partially surround the metallic core. Preferably, the at least one jacket element comprises a non-electrically conducting material. Optionally, the jacket element comprises the same material as the support member. Optionally, the jacket element is formed exclusively from a refractory or a ceramic material. Optionally, the jacket element may comprise a core material that is at least partially surrounded or encased by a refractory or a ceramic (i.e., non-electrically conducting) material formed as a coating at the external region of the jacket element and within the elongate bore. Accordingly, the jacket element is configured to be heat resistant and electrically insulating.

According to one embodiment of the invention as defined hereinabove or hereinafter, the casing comprises an outer sheath and a plurality of spacers extending radially between the outer sheath and the jacket block. Preferably, each of the spacers comprises a disc-shaped member having a central aperture through which a part of the jacket block extends. Optionally, the spacers may be formed integrally with the casing (sheath) and may be connected, fused or adhered to the sheath via chemical or mechanical attachment means. The spacers are advantageous to stabilise the jacket block within the heater and to inhibit lateral and preferably axial independent movement of the jacket block relative to the casing and/or the surrounding components of the electric heater. Optionally, the spacers may comprise a metallic material where the spacers are electrically isolated from the heating element via the non-electrically conducting jacket block.

Optionally, the heater may further comprise a bracket provided at the spacer at or towards the first lengthwise end of the jacket block, the support member extending between the bracket and the bent axial end sections. Preferably, the heater comprises at least a pair of the brackets provided at the spacer at or towards the first lengthwise end of the jacket block and wherein the support member comprises at least one rod extending from the brackets and through the bent axial end sections. Optionally, the brackets may be provided in the form of blocks positioned at each lateral side of the first lengthwise end of the jacket block. Accordingly, it may be considered that the axial end of the jacket block is sandwiched between the pair of oppositely opposed brackets. Preferably, at least respective portions of the brackets extend axially beyond the lengthwise end of the jacket block so as to overhang the jacket block. Preferably, the at least one rod is positioned to extend between the respective overhang regions of the brackets. Preferably, the at least one rod extends generally perpendicular to the elongate bore and the jacket block generally.

Preferably, the heater comprises a plurality of the jacket elements assembled together as a unitary body and at least partially surrounded by the spacers. The jacket elements are assembled and bound together as an assembly optionally via the spacers and/or other support members positioned at different regions along the length of the jacket block so as to positionally secure the jacket block relative to the casing and other components of the electric heater.

Optionally, the sheath comprises a generally hollow cylindrical or hollow cuboidal shape encapsulating the heating assembly. Preferably, the spacers are attached to a radially inner surface of the sheath. Optionally, the spacers may be welded to the inner surface of the sheath for ease of manufacturing and to impart a structural strength to the heater. Accordingly, the spacers may be considered to form part of the casing.

According to a preferred implementation, the at least one jacket element comprises a plurality of jacket elements assembled together to form the elongate jacket block; the at least one support member comprises a plurality of rods and the bent axial end sections are positioned adjacent one another and are aligned into rows such that a respective rod of the plurality of rods extends through the bent axial end sections of each respective row; the casing comprises an outer sheath and the heater further comprises a plurality of spacers extending radially between the outer sheath and the jacket block, the spacers comprising central apertures through which a part of the jacket block extends; the heater further comprising a plurality of brackets provided at one of the spacers at or towards the first lengthwise end of the jacket block such that the rods extend between the brackets and through the bent axial end sections of each row.

Accordingly, the present invention provides a means to prevent damage to the heating element due to movement of the jacket elements or the heating elements. Such movement may be induced by gravity and/or pressure differentials within the electric heater as the gas is forced under pressure through the bores via an initial 'cool' end of the jacket block and a 'hot' end of the jacket block. Accordingly, the heating element is prevented from contact with the end faces of the jacket block and/or any edges or transitions between a front end face of the jacket block and each of the longitudinal bores. As indicated, the stabilisation of the heating element is achieved via contact between the support member and the bent or looped ends exiting from one bore open end and entering another bore open end.

Optionally, corresponding support members may be provided at both axial ends of the jacket block, i.e. on the gas entrance ('cool') end as well as on the gas exit ('hot') end. The heating element may be a heating wire or rod. However and preferably, the at least one support member is provided at the 'cool' end only of the heating assembly. A heating wire has the particular advantage in that it is easily bendable and may thus be fed through a plurality of bores, so that a single wire follows a meandering pass by entering and exiting neighbouring or adjacent bores or channels in series. In one embodiment, the size of a support bar, more precisely the cross-sectional area thereof, is designed such as to fit with some clearance into the eyelets formed between the bent ends (or loops) and the adjacent end face of the jacket elements/jacket block. Preferably, a cross-sectional shape profile at the external surface of the support bar is adapted to match the shape profile of the radially inner region of each bent end which may be a semi- or half circle.

Preferably, the terminal ends of the heating element enter into and exit from the same end of the tubular elements/jacket block, which is typically the 'cool' end (ambient or lower temperature) into which the gas flows relative to a 'hot' end (around 1000° C.) from which the heated gas emerges. Both terminal ends of the heating element may then be connected to corresponding terminals in order to apply voltage and accordingly heat the gas flowing through the gap defined between the heating element and the inner surface defining each bore.

For a larger array of elongate bores or channels at a jacket block, it is of course possible to use separate heating elements which may feed through different groups of bores or channels which together form the complete array.

The loose fit between i) a first side of the support bar the eyelets (formed by the bent axial end sections) and ii) a second side of the support bar and the end face of the jacket block is provided in order to accommodate any uneven thermal expansion, such that the heating element is not subject to any tension when the flow heater transitions between a hot state during operation and a cool state when deactivated.

In one embodiment, the support bars have cross-section with at least one rounded face along a contact area with the bent axial end sections, wherein the radius of the rounded face may be properly adapted to (i.e. made slightly smaller than) the radius of the bent ends of the heating element. The end faces of the jacket block may be flat (i.e. planar) and in order to adapt the shape of the supports bars in a corresponding manner, one side of the bars may be chamfered to form a flat surface. In particular, the support bars may have a chamfered circular or half circular cross-section. In case a rectangular support bar is used in view of an easier production of such bar, there may be provided grooves or recesses extending crosswise to the longitudinal direction of the bar, wherein the cross-sectional shape at least at the position of the respective recesses is adapted to the shape of each bent end section.

The hollow bores or channels of the jacket elements are preferably adapted in cross-section to the size of the external cross-section of the heating element. In the case of a normal heating wire with circular cross-section, the bores or channels each comprise a circular cross-section so as to provide a uniform (along the axial length of each bore) annular gap which facilitates heating of the gas to temperatures up to and around 1200° C. without any undue overheating or stress at the heating element. The cross-section of these bores or channels can in one embodiment also comprise spacers along the perimeter in order to centre the heating element in the bore or channel perpendicular to the longitudinal axis.

Reference within the specification to 'heating element' encompasses relatively thin wires and larger cross sectional heating rods. Such a heating rod or wire preferably comprises iron-chromium-aluminium (Fe—Cr—Al) alloy or a nickel-chrome-iron (Ni—Cr—Fe) alloy. In many practical cases the maximum internal spacing between the heating element and the internal facing surface that defines each bore is between 0.2 and 2 mm, but may also fall within a broader range between 0.02 mm and 50 mm. Optionally, in particular a thicker heating element could in turn comprise a bundle of individual rods or wires which are optionally intertwined or twisted together. With such embodiments, the above-mentioned internal spacing is defined by the internal spacing between the bundle of rods or wires relative to the inner surface that defines each longitudinal bore.

Reference within the specification to 'rod' encompasses bendable, thin wires with a small cross section, as long as the wire is sufficiently rigid and stable to extend linearly along the axis of each bore.

Reference within the specification to 'casing' encompasses those components of the electric heater that are positioned around the internally mounted heating assembly (that comprises the heating element(s) and the jacket block). Such components may include, support struts, inner or outer sheaths or housings, support braces (both internal and external at the heater), bar, rods, spokes, spacing or support flanges and the like.

Optionally, a diameter of each of the bores or channels may be in a range 1 mm to 20 mm or even 0.5 mm to 60 mm. Accordingly, a preferred ratio between the cross-sectional area of the rod or channels and the internal cross sectional area of each of the bores may be in the range 0.04 to 0.95, 0.04 to 0.8, 0.04 to 0.9, 0.2 to 0.95, 0.3 to 0.8 or 0.5 to 0.9.

The heating element extends through each bore or each channel from an inlet opening to an outlet opening. Gas to be heated flows through the bores or channels and along the heating element. The inner cross-section over the length of the bores or channels needs not to be constant, even though that is preferred, in order to produce a substantially constant clearance gap, in particular a constant annular gap between the heating element and the inner surface of each bore or channel. Each bore or each channel may comprise inner projections, which are distributed along and around the inner surface in order to keep the heating element a fixed distance from the remainder of the bore/channel surface. A substantially constant annular gap along at least 60% of the axial length of each bore or each channel is achieved with the exception of the projections engaging the heating element.

Optionally, each of the jacket elements may comprise a circular, a part-circular or curved cross sectional profile at the outer surface of each jacket element. Optionally, the external surface of each jacket element may comprise a polygonal and in particular a rectangular profile. Optionally, the jacket elements comprise a projection at a first region and a groove at a second region of at least one external surface, the projection of one of the jacket elements configured to at least partially sit within the groove of an adjacent jacket element to at least partially interlock the jacket elements. Optionally, each jacket element may comprise a rib, ridge, projection or tongue spaced apart from a corresponding groove or recess at the external surface so as to allow the jacket elements to inter-fit or tessellate with one another in an interlocking relationship. Such an arrangement is advantageous to inhibit lateral movement of the jacket elements to form a secure assembly referred to herein as the jacket block. Optionally, the respective projections and recesses/grooves may extend lengthwise along each of the jacket elements between the respective first and second ends. Optionally, the respective projections and recesses/grooves may extend widthwise or laterally across the jacket elements perpendicular to the elongate bores. Optionally, the jacket elements may be tessellated together via corresponding curved or polygonal cross sectional profiles having cooperating shapes such that the external surfaces of the jacket elements are positioned in close fitting contact with one another substantially along their full axial length. As indicated, optionally, the jacket block may be formed as a single body comprising a plurality of parallel elongate bores extending between the first and second lengthwise ends of the jacket block.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
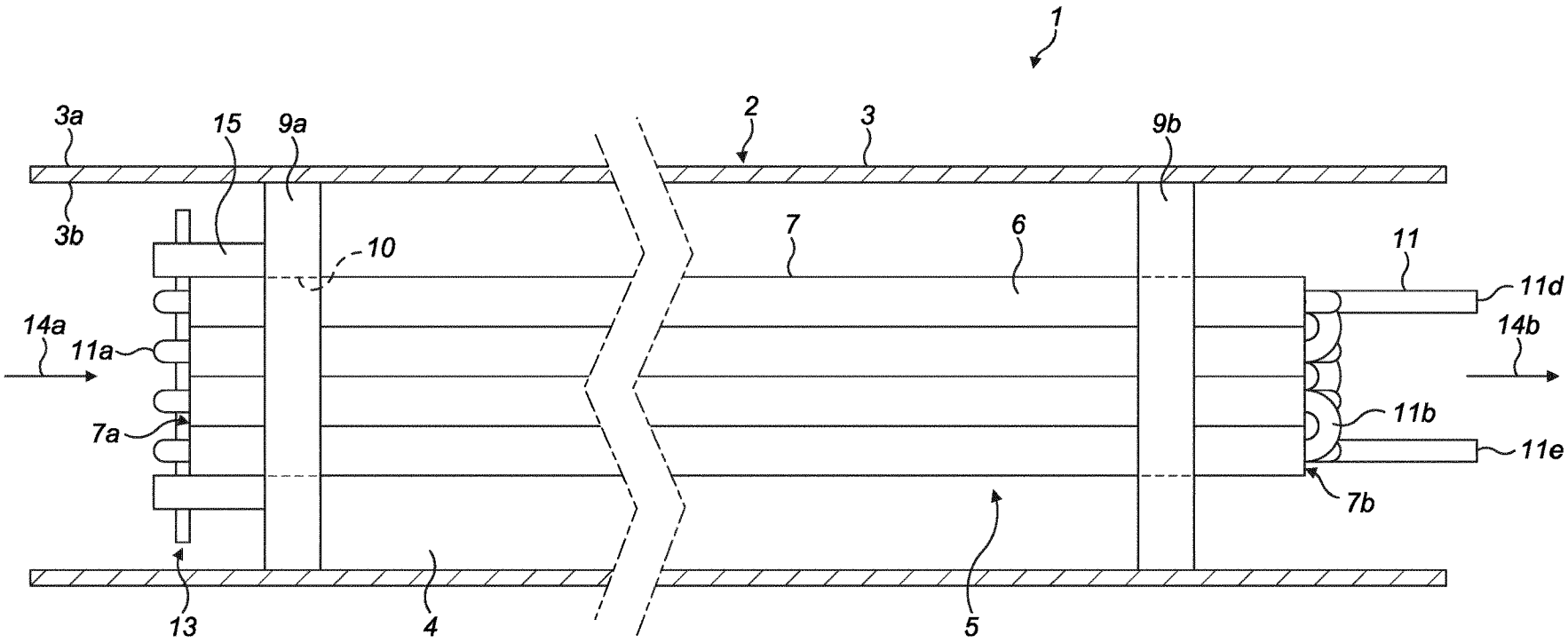
FIG. 1 is a cross sectional side view of an electric heater according to one aspect of the present invention.
Figure 2:
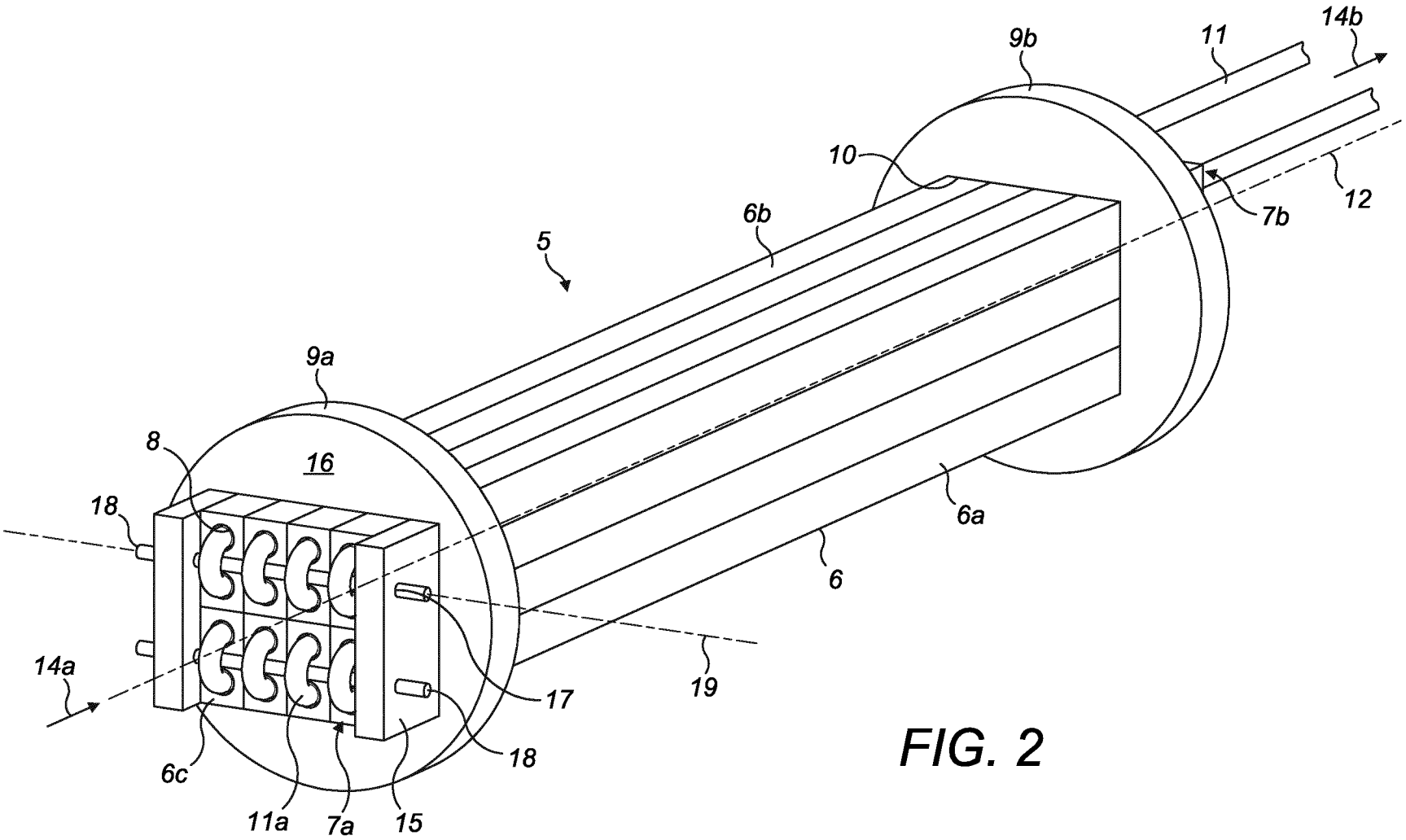
FIG. 2 is a perspective view of a heating assembly forming a part of the electric heater of FIG. 1.
Figure 3:
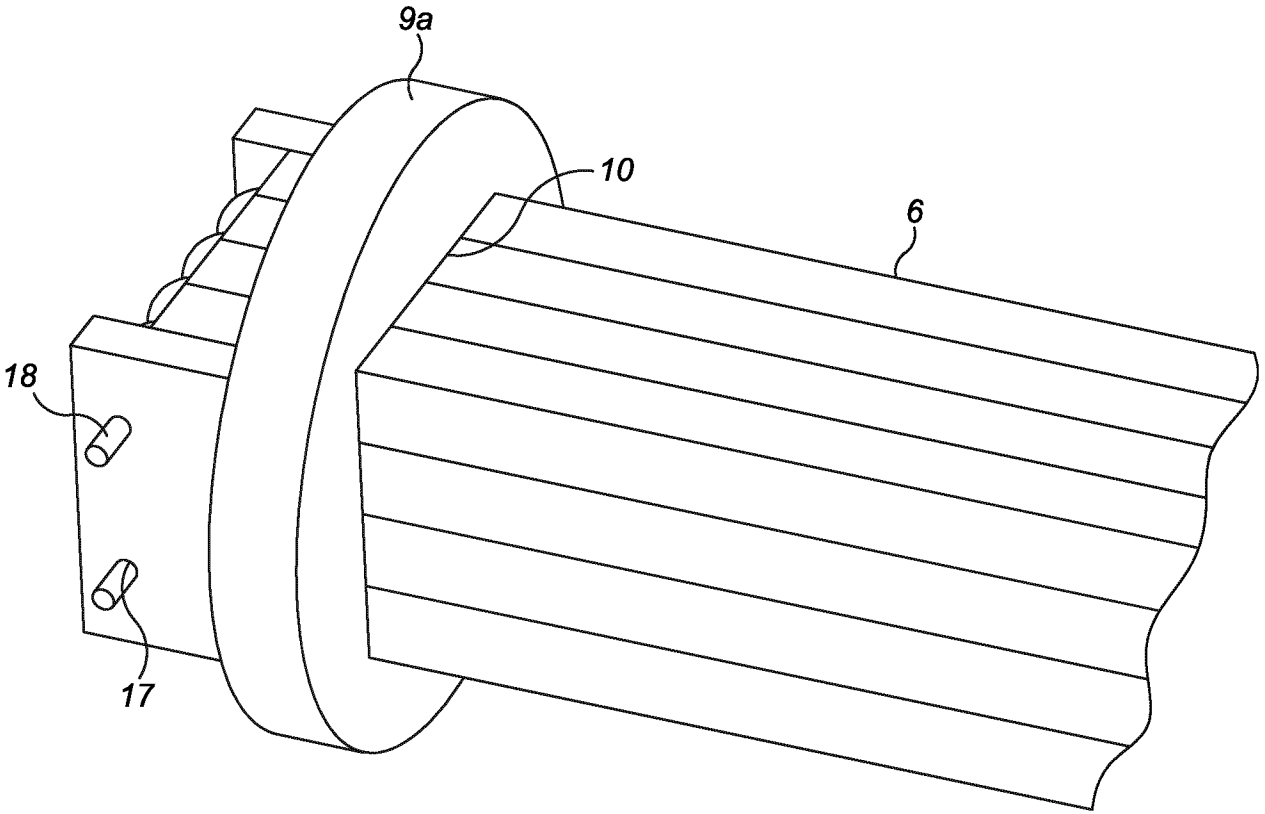
FIG. 3 is a further perspective view of a first lengthwise end of the heating assembly of FIG. 2.

Referring to FIGS. 1, 2 and 3 an electric heater 1 comprises a casing 2 in a form of a cylindrical sheath 3 (having internal and external facing surfaces 3*b*, 3*a* respectively) that defines an internal chamber 4 open at both axial ends. A heating assembly indicated generally by reference 5 is mounted within chamber 4. Heating assembly 5 is formed from a plurality of lengthwise elongate jacket elements 6 assembled and held together to form a lengthwise elongate jacket block 7. Each elongate jacket element 6 comprises a lengthwise extending longitudinal internal bore 8 extending the full length of each jacket element 6 so as to be open at a first and second axial end 7*a*, 7*b* of the jacket block 7. The jacket element 6 and jacket block 7 are formed as hollow bodies in which the solid mass and volume extends continuously between the first and second axial ends 7*a*, 7*b*. That is, the jacket elements 6 and jacket blocks 7 are not discontinuous between respective ends 7*a*, 7*b*. Such an arrangement is advantageous to maximise the extent and efficiency of thermal energy transfer within the respective jacket elements 6 as explained in further detail herein.

Jacket block 7 is mounted in position (within casing 2) via a pair of disc-shaped spacers 9*a*, 9*b* positioned in a lengthwise direction towards each jacket block axial end 7*a*, 7*b*. Sheath 3 and spacers 9*a*, 9*b* may be formed from metal such that spacers 9*a*, 9*b* are secured to an internal facing surface 3*b* of sheath 3 via welding. Each spacer 9*a*, 9*b* comprises a central aperture 10 having a rectangular shape profile and dimensioned to accommodate jacket block 7 that also comprises an external generally cuboidal shape profile. Accordingly, jacket block 7 is mounted within each spacer aperture 10 so as to be suspended within chamber 4 and spatially separated from sleeve internal facing surface 3*b*.

A heating element indicated generally by reference 11 is formed as an elongate rod having respective ends 11*d*, 11*e* projecting generally from one of the axial ends of jacket block 7. Ends 11*d*, 11*e* are illustrated in FIGS. 1 to 3 projecting from the 'hot' end 7*b* of the jacket block 7 for illustrative purposes. Ends 11*d*, 11*e*, preferably extend from the 'cool' end 7*a* of jacket block 7. Heating element 11 comprises a generally circular cross sectional profile and is dimensioned slightly smaller than the cross-sectional area of each jacket element bore 8. The single heating element 11 is adapted to extend sequentially through each elongate bore 8 of the jacket block 7 via respective bent axial end sections 11*a* and 11*b*. In particular, heating element 11 emerges from one bore 8 of a first jacket element 6 is bent through 180° (heating element end section 11*a*) so as to return into an adjacent or neighbouring bore 8 at the jacket block first axial end 7*a*. This is repeated at the jacket block second axial end 7*b* via bent end sections 11*b*. Heating element ends 11*d*, 11*e* are capable of being coupled to electrical connections to enable a current to be passed through element 11 as will be appreciated.

Figure 5:
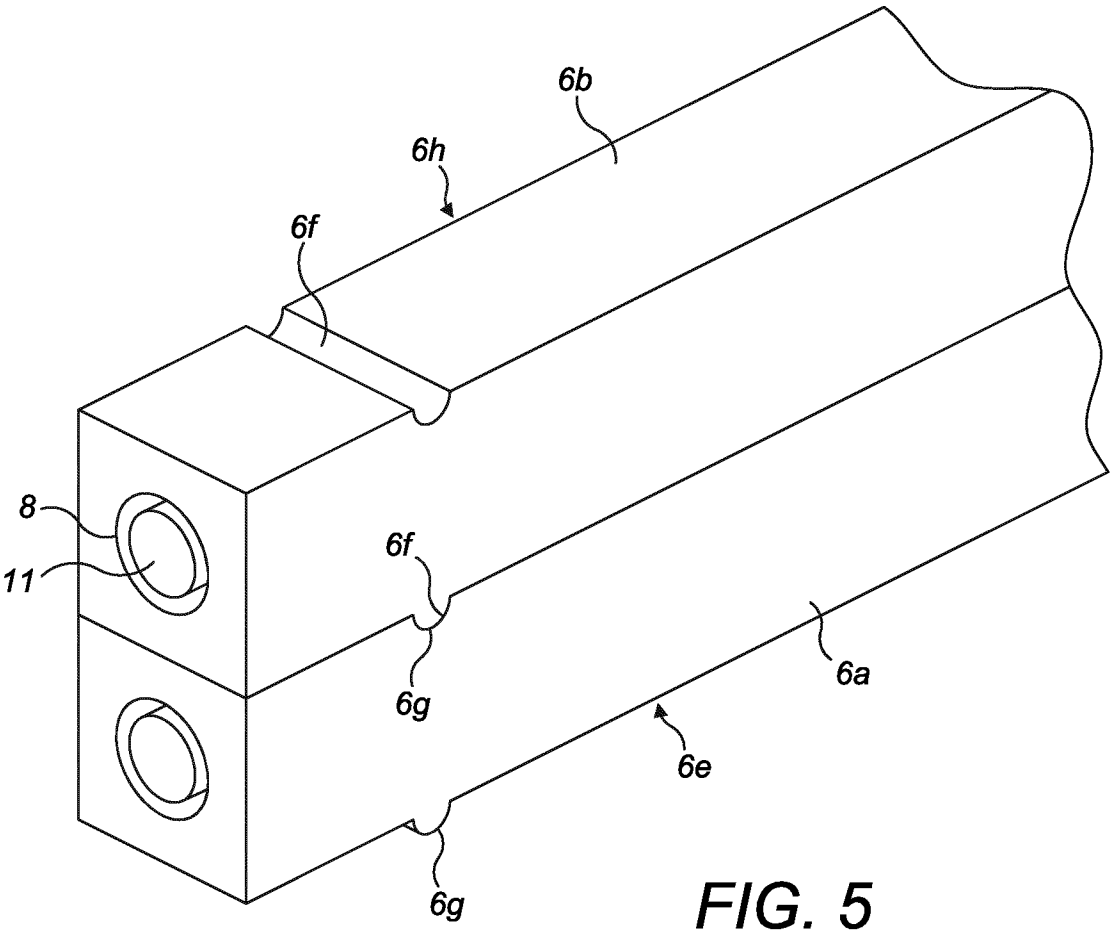
FIG. 5 is a perspective view of neighbouring and adjacent jacket elements forming a part of the heating assembly of FIG. 4.

Referring to FIG. 5, each jacket element 6 comprises four longitudinal extending side faces 6*a*, 6*b*, 6*e* and 6*h* that are generally planar such that each jacket element comprises an external generally square cross sectional shape profile adapted to enable the jacket elements to sit together in touching contact to form a rectangular cuboidal unitary body in which the individual side faces of the jacket elements 6 form the external facing surfaces of the jacket block 7. A small gap is provided between each spacer aperture 10 and the external surfaces of jacket block 7 (defined by jacket element side faces 6*a*, 6*b*, 6*e*, 6*h*). Such gaps accommodated differential thermal expansion of the spacers 9*a*, 9*b* (typically formed from metal) and the jacket elements 6 that are preferably formed from a non-electrically conducting refractory material. However, at least some structural support of the jacket block 7 and heating element 11 is provided by spacers 9*a*, 9*b* (via apertures 10) that are at least partially in contact with jacket block 7. To inhibit axial and lateral movement of each of the individual jacket elements 6 (relative to a longitudinal axis 12 extending through heater 1), each jacket element 6 comprises a groove 6*f* and a corresponding rib 6*g* extending laterally across jacket elements 6 and perpendicular to axis 12. The grooves 6*f* and ribs 6*g* of neighbouring jacket elements 6 are adapted to inter-fit one another to provide a part-tessellating jacket block 7 resistant to axial loading forces and lateral shear forces. The groove and rib arrangement (6*f*, 6*g*) of FIG. 5 is complementary to the positional holding of the heating assembly 5 via spacers 9*a*, 9*b*.

Figure 4:
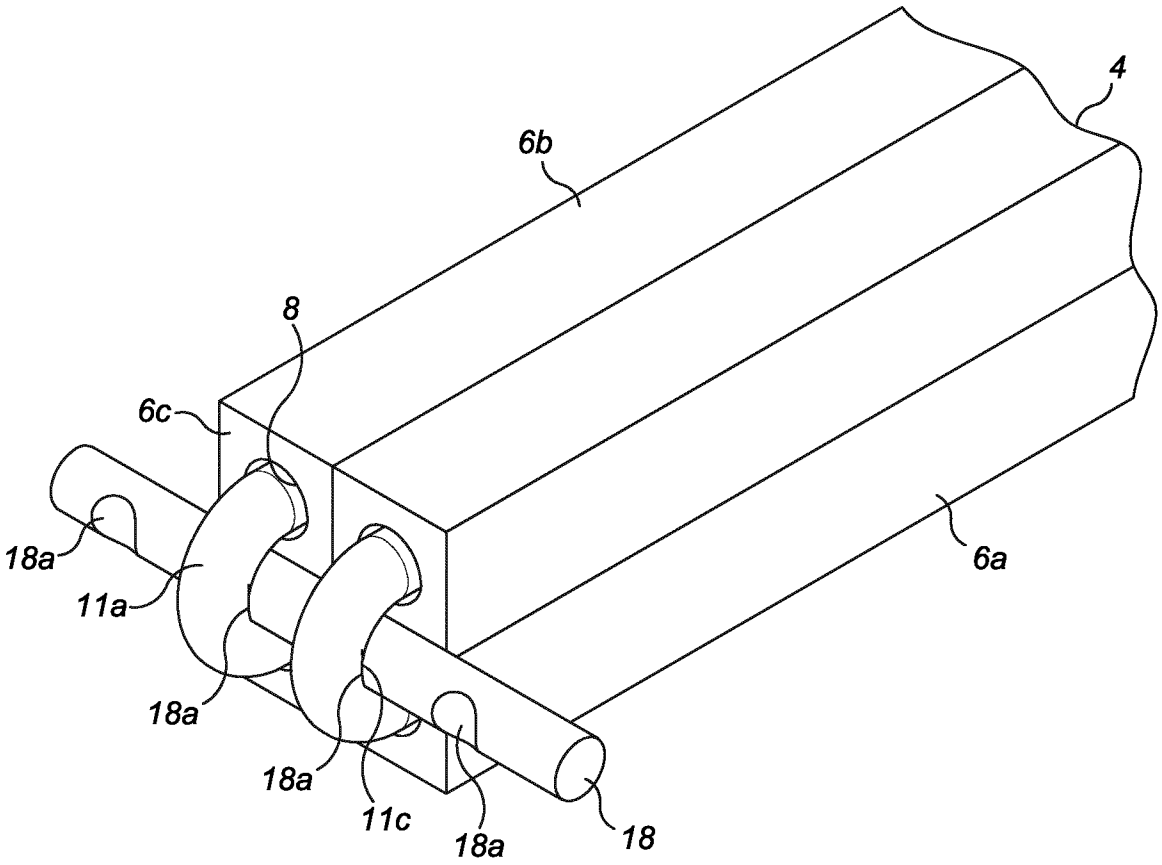
FIG. 4 is a further perspective view of the first lengthwise end of the heating assembly of FIG. 3.

The present electric heater is specifically configured with at least one support member 13 (alternatively termed a heating element stabilisation unit) configured to positionally stabilise the heating element 11 relative to the jacket block 7, spacers 9*a*, 9*b* and/or casing 2 (encompassing sheath 3). Such an arrangement is advantageous to minimise independent movement of the heating element 11 with respect to the jacket block 7 and specifically the jacket block axial ends 7*a*, 7*b*. As will be appreciated, the dimensions of the heating element 11 and bores 8 are carefully controlled to achieve a desired small separation gap between the inward facing surface of each bore 8 and the external surface of heating element 11. Such an arrangement is advantageous to maximise the effectiveness and efficiency of heat energy transfer from element 11 to a gas phase medium initially introduced into the chamber 4 at position 14*a* to then flow through each of the bore 8 and exit from the heating assembly 5 at position 14*b*. This effectiveness and efficiency of heat energy transfer is also provided, in turn, by the heating elements 6 extending continuously lengthwise (axially) between respective ends 7*a*, 7*b*. In particular, heating element 11 is entirely and continuously housed, covered and contained by the elongate jacket elements 6 between ends 7*a*, 7*b*. When the electric heater 1 is suspended vertically in use, undesirable contact between the bent end sections 11*a*, 11*b* and the end faces 6*c*, and in particular the annular edges that define the entry and exit end of each bore 8, contribute to fatigue and damage to the heating element 11 and a corresponding reduction in the service lifetime of the heater 1. To mitigate this, the heating element support member 13 is specifically provided to inhibit and in particular prevent any axial and lateral movement of the heating element 11 (independently of jacket block 7). Advantageously, the support member 13 is positioned at a 'cool' axial end of the heating assembly 5 corresponding to the gas inflow 14*a* in contrast to a 'hot' axial end for heated gas outflow (position 14*b*). The 'cool' first axial end 7*a* is the region of lower stress (lower temperature differential) relative to the second axial end 7*b* and therefore stabilisation at the first axial end 7*a* is more practical and effective. The support member 13 comprises a pair of spaced apart brackets 15 that are secured to a front face 16 of spacer 9*a* so as to project forwardly into the oncoming gas flow 14*a*. Each bracket 15 projects beyond the axial end face 6*c* of the jacket block 7. Boreholes 17 extend through each bracket 15 along axis 19 extending perpendicular to main longitudinal axis 12 of the heater 1. An elongate rod (or bar) 18 is mounted within each borehole 17 to be centred on axis 19 and to extend between each of the opposed brackets 15 and laterally across the end face 6*c* of the jacket block 7. The present invention comprises a plurality of stabilisation rods 18 each extending parallel to one another and perpendicular to the main longitudinal axis 12. As illustrated in FIGS. 1, 2 and 4, the bent axial sections 11*a* are arranged in rows at each end face 6*c* so as to accommodate a single respective rod 18 that is inserted and passes through and under each of the bent sections 11*a* so as to be positioned or at least partially entrapped between the bent (or looped) end sections 11*a* and the collective end face 6*c* of the jacket block 7. In such a configuration, the heating element 11 is prevented from movement in the gas flow direction (from position 14*a* to 14*b* along axis 12) due to contact with the rod 18 which is held securely in fixed position via brackets 15.

Referring to FIG. 4, each rod 18 comprises a plurality of recesses 18*a* that are space apart along the length of rod 18 to correspond to the region of contact (or near contact) with each bent end section 11*a*. Each recess 18*a* is curved and complementary to the curved profile of the heating element at a radially inner region 11*c* at each bent end section 11*a*. That is, each heating element in each region 11*c* is at least partially accommodated within each respective recess 18*a*. Such an arrangement is advantageous to provide (or increase) lateral stabilisation of heating element 11 (in a direction perpendicular to longitudinal axis 12). The present electric heater having an axially and laterally stabilised heating element 11 is configured with an extended operation lifetime via minimised independent movement of the heating element 11 relative to the heating assembly 5 and in particular jacket block 7.

As will be appreciated, whilst the subject invention is described with reference to elongate rods 13 inserted through each bent end section 11*a*, the same stabilisation may be achieved via alternative components and arrangements in which the bent end sections 11*a* are contacted by an abutment component that is secured, either directly or indirectly to casing 2 (for example via intermediate brackets 15 and/or spacers 9*a*, 9*b*). For example, such abutment components may comprise eyelets, hook shaped members, plates or washers adapted to at least partially sit between the radially inner region 11*c* of each end section 11*a* and the end face 6*c* of jacket block 7.

The invention claimed is:

1. An electric heater to heat a flow of a fluid, comprising:

at least one axially elongate jacket element defining an axially elongate jacket block having first and second lengthwise ends;

a plurality of longitudinal bores or channels extending internally through the jacket block and being open at each of the respective first and second lengthwise ends;

at least one heating element extending axially through the bores or channels and having respective bent axial end sections such that the at least one heating element emerges from and returns into adjacent or neighbouring bores or channels at one or both the respective first and second lengthwise ends, the at least one heating element and the jacket block forming a heating assembly; and a casing positioned to at least partially surround the heating assembly, wherein at least one support member is connected to or projecting from the casing to contact at least some of the bent axial end sections and inhibit axial and/or lateral movement of the at least one heating element relative to the jacket block and/or the casing, wherein the at least one support member comprises at least one rod extending between the bent axial end sections and the first lengthwise end of the jacket block, and wherein the at least one rod is positioned in contact or near-touching contact with the least one heating element at respective inner regions of the bent axial end sections.

2. The electric heater as claimed in claim 1, wherein the at least one rod is part of a plurality of rods, wherein the bent axial end sections of the at least one rod is part of a plurality of bent axial end sections, and wherein each rod of the plurality of rods extends respectively between each of the plurality of bent axial end sections and the first lengthwise end.

3. The electric heater as claimed in claim 2, wherein the plurality of bent axial end sections are positioned adjacent one another and are aligned in a row and a respective rod of the plurality of rods extends through the bent axial end sections aligned in the row.

4. The electric heater as claimed in claim 1, wherein each of the at least one rods comprises recesses to at least partially receive a portion of the at least one heating element at each of the respective bent axial end sections.

5. The electric heater as claimed in claim 1, wherein the at least one support member comprises a generally circular, polygonal or rectangular cross sectional profile.

6. The electric heater as claimed in claim 1, wherein the at least one heating element is bent through 170° to 190° at the bent axial end sections.

7. The electric heater as claimed in claim 1, wherein the at least one support member comprises an electrically non-conducting material.

8. The electric heater as claimed in claim 7, wherein the electrically non-conducting material is formed as a coating on the at least one support member.

9. The electric heater as claimed in claim 8, wherein the at least one support member comprises a metallic core and the electrically non-conducting material is formed as a coating to at least partially surround the metallic core.

10. The electric heater as claimed in claim 9, wherein each of the jacket elements comprise a projection at a first region and a groove at a second region at at least one external surface, the projection of one of the jacket elements configured to at least partially sit within the groove of an adjacent jacket element to at least partially interlock the jacket elements.

11. The electric heater as claimed in claim 1, wherein the at least one jacket element comprises an electrically non-conducting material.

12. The electric heater as claimed in claim 1, wherein the casing comprises an outer sheath and a plurality of spacers extending radially between the outer sheath and the jacket block.

13. The electric heater as claimed in claim 12, further comprising a bracket provided at one or more of the plurality of spacers at or towards the first lengthwise end of the jacket block, and wherein the at least one support member extends between the bracket and the bent axial end sections.

14. The electric heater as claimed in claim 13, wherein the support member comprises at least one rod extending from one or more brackets and through the bent axial end sections, and wherein the rod extends generally perpendicular to the bores or channels.

15. The electric heater as claimed in claim 12, comprising at least a pair of brackets provided at each of the plurality of spacers at or towards the first lengthwise end of the jacket block and wherein the at least one support member comprises at least one rod extending from the pair of brackets and through the bent axial end sections.

16. The electric heater as claimed in claim 15, wherein the rod extends generally perpendicular to the bores or channels.

17. The electric heater as claimed in claim 12, comprising a plurality of the jacket elements assembled together as a unitary body and at least partially surrounded by the spacers.

18. The electric heater as claimed in claim 17, wherein the outer sheath comprises a generally hollow cylindrical or hollow cuboidal shape encapsulating the heating assembly.

19. The electric heater as claimed in claim 18, wherein the plurality of spacers are attached to a radially inner surface of the outer sheath.

20. The electric heater as claimed in claim 1, wherein the at least one heating element is bent through 180° at the bent axial end sections.

21. An electric heater to heat a flow of a fluid, comprising:

at least one axially elongate jacket element defining an axially elongate jacket block having first and second lengthwise ends;

a plurality of longitudinal bores or channels extending internally through the jacket block and being open at each of the respective first and second lengthwise ends;

at least one heating element extending axially through the bores or channels and having respective bent axial end sections such that the at least one heating element emerges from and returns into adjacent or neighbouring bores or channels at one or both the respective first and second lengthwise ends, the at least one heating element and the jacket block forming a heating assembly; and a casing positioned to at least partially surround the heating assembly, wherein at least one support member is connected to or projecting from the casing to contact at least some of the bent axial end sections and inhibit axial and/or lateral movement of the at least one heating element relative to the jacket block and/or the casing, wherein the casing comprises an outer sheath and a plurality of spacers extending radially between the outer sheath and the jacket block, and wherein each of the plurality of spacers comprises a disc shaped member having a central aperture through which a part of the jacket block extends.

22. An electric heater to heat a flow of a fluid, comprising:

at least one axially elongate jacket element defining an axially elongate jacket block having first and second lengthwise ends;

a plurality of longitudinal bores or channels extending internally through the jacket block and being open at each of the respective first and second lengthwise ends;

at least one heating element extending axially through the bores or channels and having respective bent axial end sections such that the at least one heating element emerges from and returns into adjacent or neighbouring bores or channels at one or both the respective first and second lengthwise ends, the at least one heating element and the jacket block forming a heating assembly; and a casing positioned to at least partially surround the heating assembly, wherein at least one support member is connected to or projecting from the casing to contact at least some of the bent axial end sections and inhibit axial and/or lateral movement of the at least one heating element relative to the jacket block and/or the casing, and wherein:

the at least one jacket element comprises a plurality of jacket elements assembled together to form the elongate jacket block;

the at least one support member comprises a plurality of rods and the bent axial end sections are positioned adjacent one another and are aligned into rows such that a respective rod of the plurality of rods extends through the bent axial end sections of each respective row;

the casing comprises an outer sheath and the heater further comprises a plurality of spacers extending radially between the outer sheath and the jacket block, the spacers comprising central apertures through which a part of the jacket block extends; and the heater further comprising a plurality of brackets provided at one of the spacers at or towards the first lengthwise end of the jacket block such that the rods extend between the plurality of brackets and through the bent axial end sections of each row.

* * * * *